US008087358B2

(12) United States Patent
Izawa et al.

(10) Patent No.: US 8,087,358 B2
(45) Date of Patent: Jan. 3, 2012

(54) TEXTILE PRINTING METHOD AND APPARATUS

(75) Inventors: Hideo Izawa, Sakura (JP); Takao Namiki, Sakura (JP); Akira Ishikawa, Kamagaya (JP); Yuuichi Yamazaki, Kashiwa (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 227 days.

(21) Appl. No.: 12/571,683

(22) Filed: Oct. 1, 2009

(65) Prior Publication Data

US 2010/0077554 A1 Apr. 1, 2010

(30) Foreign Application Priority Data

Oct. 1, 2008 (JP) ..... 2008-256494

(51) Int. Cl.
*B41F 17/00* (2006.01)

(52) U.S. Cl. ..... 101/483; 101/36; 101/37; 101/91

(58) Field of Classification Search ..... 101/36, 101/37, 91, 483
See application file for complete search history.

(56) References Cited

U.S. PATENT DOCUMENTS

2008/0106565 A1* 5/2008 Miyazawa ..... 347/16

FOREIGN PATENT DOCUMENTS

JP 08-156353 A 6/1996
JP 2007-169812 A 7/2007

* cited by examiner

*Primary Examiner* — Amina Khan
(74) *Attorney, Agent, or Firm* — Westerman, Hattori, Daniels & Adrian, LLP

(57) ABSTRACT

To enable fabric of any length to be continuously printed without causing a textile printing unit to cease its operation, a textile printing method is provided in which fabric is conveyed by a conveyer belt and passed through a printing section to print on the fabric, the printing section having a textile printing ink jet printer disposed opposite the conveyer belt, wherein the printing section is continuously supplied with the fabric comprising a plurality of successive sheets of fabric, each sheet having a given length, such a sheet of fabric for supply into the printing section having a terminal end tied with a starting end of a sheet of a fabric for continuous succeeding supply in the state that the terminal and starting ends are in contact with each other.

3 Claims, 6 Drawing Sheets

TEXTILE PRINTING METHOD AND APPARATUS

TECHNICAL FIELD

The present invention relates to a textile printing method and apparatus in which an elongated sheet of fabric or cloth is printed with a textile printing ink jet printer.

BACKGROUND ART

A textile printing method of this type in the prior art has been carried out using a textile printing apparatus as shown in FIG. 1 (see JP H08-156353 A). In such a conventional textile printing method, fabric 3 wound in the form of a roll is set at a fabric supply section 2 upstream of a printing section 1 and the roll formed fabric 3 is unwound into the form of a sheet. And, the fabric 3 of sheet form is printed as desired with a textile printing ink jet printer 4 in the printing section 1, then passed through a dryer 5 and finally taken up onto a take-up roller 6. And, in the printing section 1 there are provided: a conveyer belt 8 guided by guide rollers 8*a* and 8*b* whereby the fabric 3 to be printed with the textile printing ink jet printer 4 is guided to travel; and a thickness detection sensor 7 upstream of the textile printing ink jet printer 4 for detecting a thickness of the fabric 3 to adjust the height of the rollers 8*a* and 8*b*, thereby making the height in conveying surface of the conveyer belt 8 adjustable. The apparatus shown in FIG. 1 also includes an inlet guide roller 9, a belt tensioning roller 10, and a belt tensioning adjustor spring 11.

In the conventional textile printing method in which the fabric 3 wound in a roll form and set in the fabric supply section as mentioned above is unwounded or drawn out for supply into the textile printing ink jet printer 4 via the guide roller 9, the apparatus is needed to cease its operation each time one roll of fabric 3 finishes printing and a new roll of fabric 3 needs to be mounted and passed into the textile printing section 1 for its reoperation.

On the other hand, since fabric 3 is of a material large in stretchability, it is difficult to wind the fabric in the form of a roll of large diameter and the rolled fabric 3 set in the supply section 2 must be of small diameter. Since the fabric 3 thus in length cannot but be not so much long, reoperation caused by replacements of the rolled fabric in the supply section must frequently occur, giving rise to the problem that the production efficiency remains unimproved.

In view of what is mentioned above, it is an object of the present invention to provide an improved textile printing method which allows a sheet of fabric elongated in length to be continuously printed without causing a textile printer to cease its printing operation whereby such an elongated sheet of fabric can be printed at an increased productivity. Another object of the present invention is to provide an improved textile printing apparatus for carrying out the textile printing method.

SUMMARY OF THE INVENTION

In order to achieve the first object mentioned above, there is provided in accordance with the present invention a textile printing method in which fabric is conveyed by a conveyer belt and passed through a printing section to print on the fabric, the printing section having a textile printing ink jet printer disposed opposite the conveyer belt, characterized in that the method includes continuously supplying the printing section with the fabric comprising a plurality of successive sheets of fabric, each sheet having a given length, such a sheet of fabric to be supplied into the printing section having a terminal end tied with a starting end of a sheet of fabric to be successively supplied in the state that the terminal and starting ends are in contact with each other.

The textile printing method mentioned above may include detecting by a sensor, upstream of the printing section, a portion of tying one sheet of fabric with another, and in response to the detection, lowering the conveyer belt for fabric conveying while the fabric tying portion is being passed through the printing section so that the fabric tying portion may not interfere with a printing head in the printing section.

In order to achieve the second object mentioned above, the present invention provides a textile printing apparatus including a printing section having a textile printing ink jet printer disposed opposite a conveyer belt and in which fabric is conveyed by the conveyer belt and passed through the printing section to print on the fabric with the textile printing ink jet printer, characterized in that the apparatus comprises:

a fabric supply section for supplying the fabric into the printing section, the fabric supply section having a plurality of fabric trays arranged in the direction of supply of the fabric and a fabric joining unit for tying together a terminal end of a sheet of fabric in the fabric tray downstream in the direction of supply of the fabric and a starting end of a sheet of fabric in the fabric tray upstream in the direction of supply of the fabric in the state that the terminal and starting ends are in contact with each other; and a detection sensor for detecting, upstream of the printing section, a portion of tying of one sheet of fabric with another to lower the conveyer belt while the fabric tying portion is being passed through the printing section so that the fabric tying portion may not interfere with a printing head in the printing section.

According to the textile printing method of the present invention, the action of a fabric take-up roller as in the prior art may be replaced by folding, piling up and accumulating a sheet of fabric after printing, so that a sheet of fabric, whatsoever length it may have, can be printed continuously with a textile printer without causing the textile printer to cease its printing operation, whereby such an elongated sheet of fabric may be printed at an improved productivity and a stabilized quality of the elongated product.

And, since fabric as its successive sheets, each of which is of a given length and better formed in a lump such as by folding, is supplied to the textile printer while such sheets are being tied together with a joining unit, it is possible to effectively eliminate its quantitative limitation in amount of continuous supply to the textile printer.

Further, the ability to continuingly supply fabric may omit an operation needed to set up fabric in the fabric supply section for each given length, thereby achieving reduction of labor in operations.

Also, an improved textile printing apparatus can be made up in accordance with the present invention, by modifying the fabric supply section just in the conventional textile printing apparatus to include a plurality of fabric trays along with a fabric joining unit for tying together successive sheets of fabric at their respective terminal and starting ends from the adjacent fabric trays in the state that these terminal and starting ends are in contact with each other. The improved textile printing apparatus for carrying out the aforementioned method can thus be provided at economy.

BEST MODES FOR CARRYING OUT THE INVENTION

Figure 1:
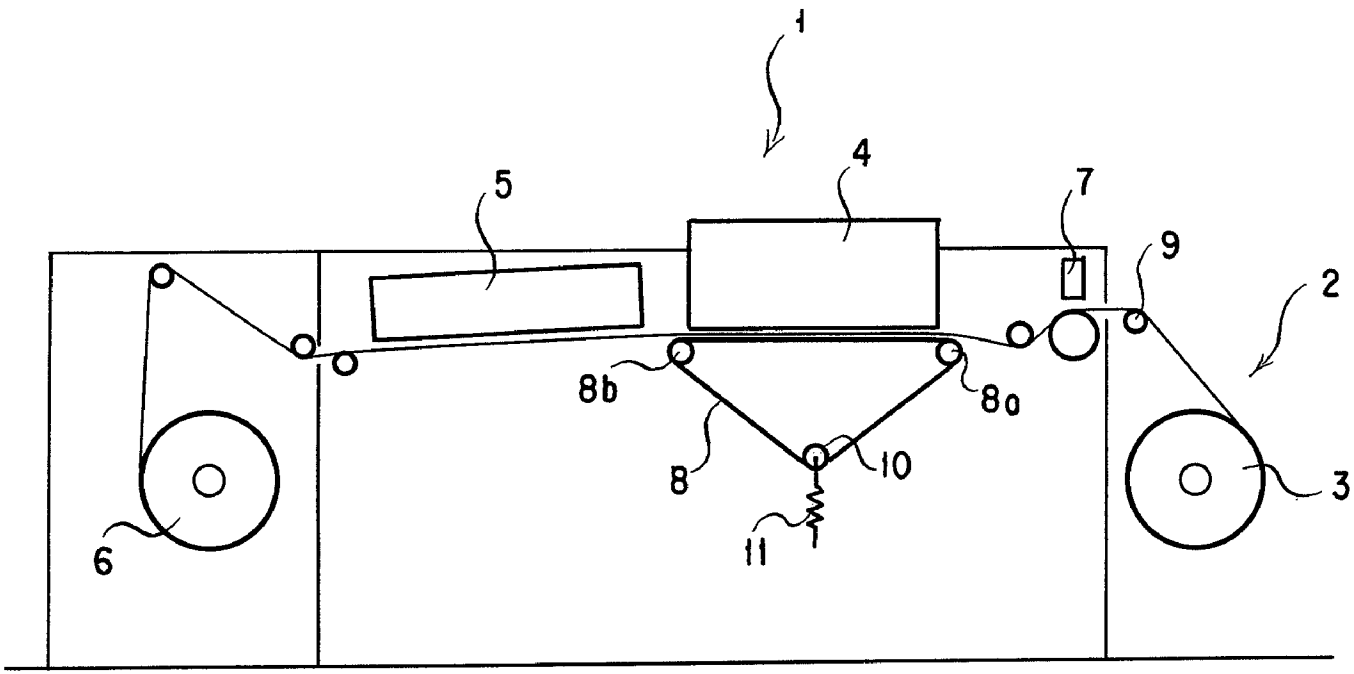
FIG. 1 is a front view diagrammatically illustrating a textile printing apparatus in the prior art.
Figure 2:
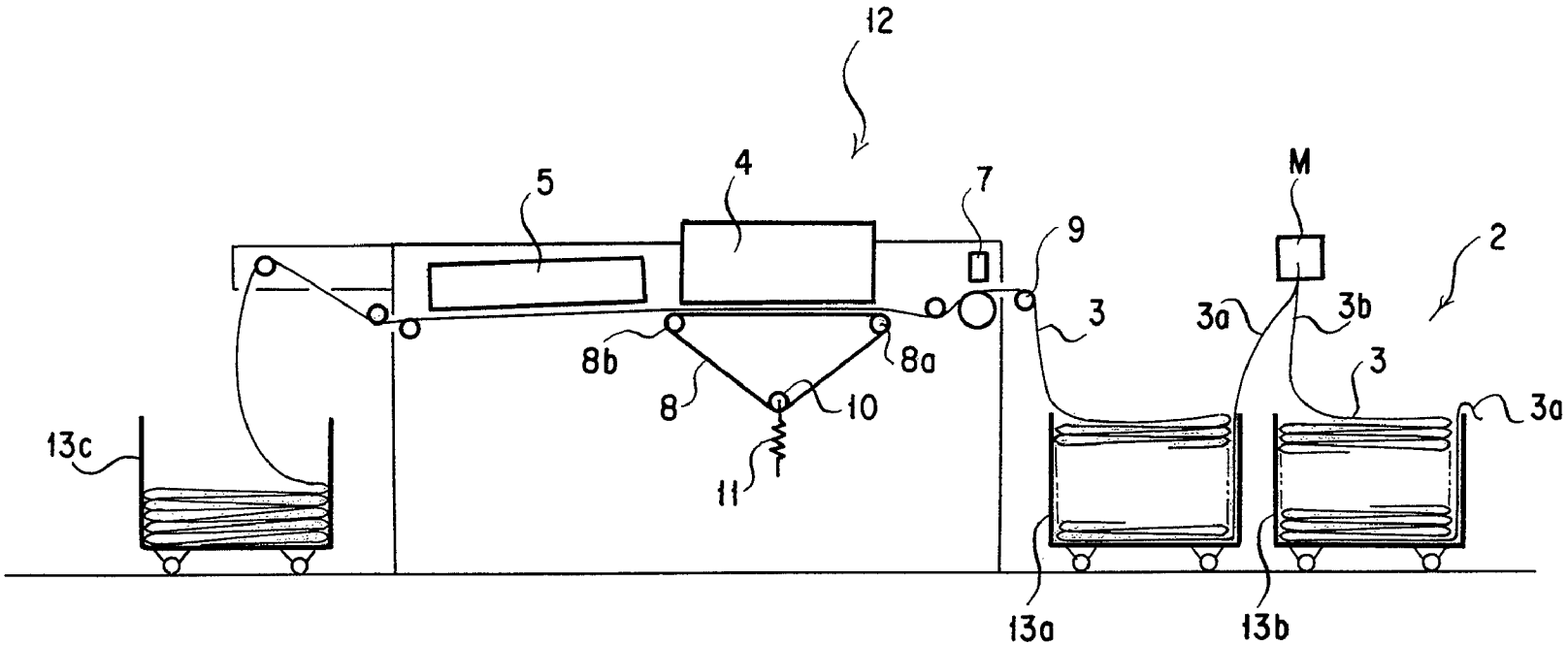
FIG. 2 is a front view diagrammatically illustrating a textile printing apparatus according to the present invention.

FIG. 2 shows a textile printing apparatus for carrying out a textile printing method of the present invention. In the textile printing apparatus shown in FIG. 2, the components identical to those in the conventional textile printing apparatus shown in FIG. 1 are designated by the same reference characters and their repeated description is omitted.

In the fabric supply section 2 of the textile printing apparatus, at least two movable fabric trays 13*a* and 13*b* are disposed placed side by side in the path and in the direction of fabric travel in the textile printing section 12. And, two successive sheets of fabric 3 and 3 of a given length are received in the adjacent fabric trays 13*a* and 13*b*, respectively, as they are each folded in a zigzag pattern, collected and piled up. Also, at least one fabric tray 13*c* is disposed at an outlet side of the textile printing section 12.

As for the fabric sheets 3 and 3 received in the fabric trays 13*a* and 13*b* at the fabric supply section 2 side, respectively, one closer to a textile printing section 12, i. e., the one fabric sheet 3 received in the first fabric tray 13*a* downstream in supply direction of the fabric 3 and one far, i. e., the other fabric sheet 3 received in the second fabric tray 13*b* upstream in supply direction of the fabric 3 have a terminal end 3*a* and a starting end 3*b*, respectively, which are sewed up and tied together as they are in contact with each other, using a joining unit M.

These terminal and starting ends 3*a* and 3*b* are sewed up and tied together by overlocking in a known manner, e. g., with a plain seaming thread and a first and a second looper thread (see JP 2007-169812 A).

Figure 3:
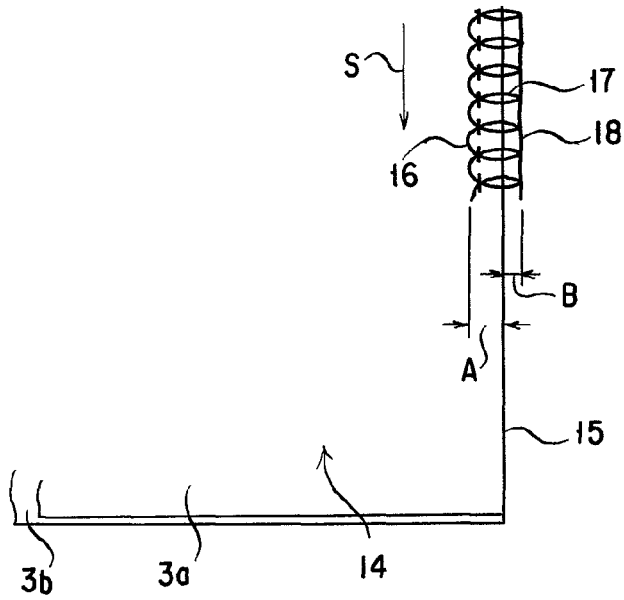
FIG. 3 is a process chart illustrating a manner of sewing together a terminal and a starting end of successive sheets of fabric.
Figure 4:
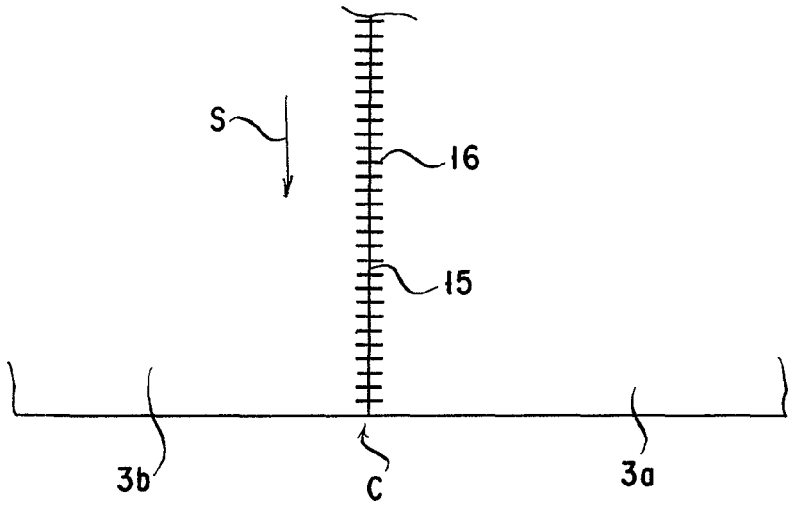
FIG. 4 is a view on one plane illustrating successive sheets of fabric whose terminal and starting ends have been sewed together.
Figure 5:
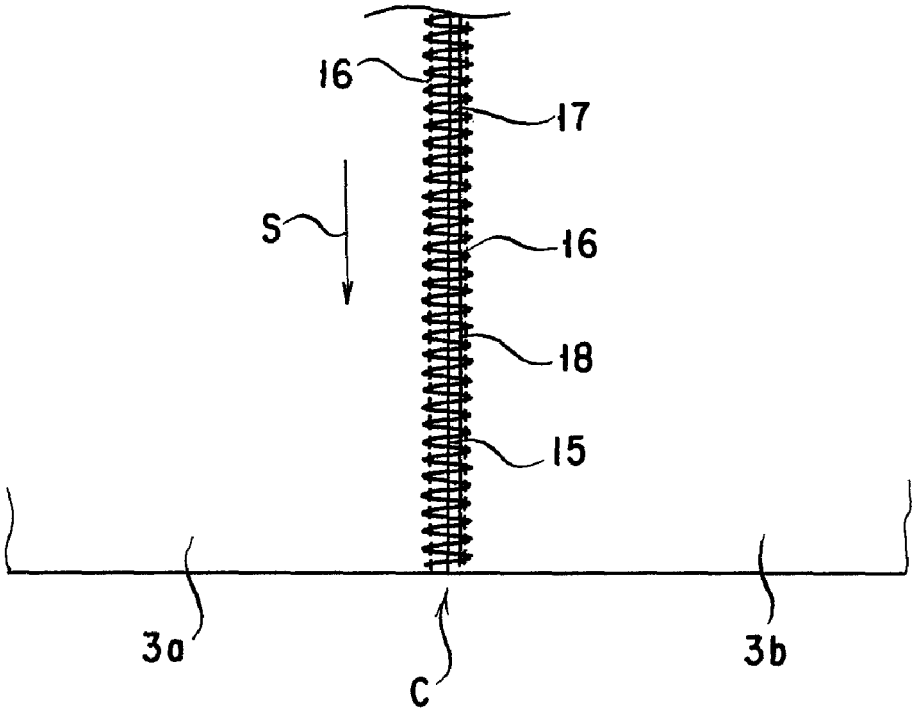
FIG. 5 is a view on the other plane illustrating successive sheets of fabric whose terminal and starting ends have been sewed together.

Referring to FIGS. 3 and 4, an explanation is given of overlocking mentioned above.

First, as shown in FIG. 3, the terminal end 3*a* of one fabric sheet 3 and the starting end 3*b* of the other fabric sheet 3 are trued up at their respective edge portions which are placed one on the other to form a laminate 14. Then, with an overlock machine unit M constituting the joining unit, the laminate 14 is seamed inwards as shown with a spacing A from its edge 15 using a plain seaming thread 16 and is overlocked outwards as shown with a spacing B with a first looper thread 17 and a second looper thread 18. Thereafter, the terminal end 3*a* of the one fabric sheet 3 and the starting end 3*b* of the other fabric sheet 3 in the laminate 14 are opened approximately by 180 degrees about the edge 15 of the laminate 14 into generally a plane with the result that as shown in FIG. 4 they in the tying region C are arranged in contact with, and without overlapping, each other.

In one of the planes of the tying region C stitches are formed by the plain seaming thread 16 as shown in FIG. 4 and in the other plane stitches by the plain seaming thread 16, stitches by the looper thread 17 and stitches by the looper thread 18 are formed in this order in the stitch forming direction S.

Note that the terminal end 3*a* and the starting end 3*b* of the one and other fabric sheets 3 and 3 may be tied or joined together by any other known tying or joining method if it allows them to be tied or joined together with them in contact with each other.

Fabric 3 in the textile printing apparatus is printed in the state that the terminal end 3*a* of a sheet of fabric 3 received in the first fabric tray 13*a* and the starting end 3*b* of a sheet of fabric 3 received in the second fabric tray 13*b* are tied together and by passing the fabric 3 through the textile printing section 12, beginning with a starting end of fabric sheet 3 received with the first tray 13*a* closer to the textile printing section 12. And then, the printed fabric 3 is dried through the dryer 5 and then folded at the outlet by the known folding unit (not shown) into a zigzag pattern in the fabric tray 13*c* and piled up for its accumulation.

As the fabric sheet 3 in the first fabric tray 13*a* finishes printing, the starting end 3*b* of the fabric sheet 3 received in the second fabric tray 13*b* with which the terminal end 3*a* of that fabric sheet 3 has been joined is continuingly supplied into the printing section 12.

Then, the first fabric tray 13*a* which becomes empty is removed and the second fabric tray 13*b* is displaced closer to the printing section 12. At the same time, the emptied fabric tray 13*a* is displaced behind the second fabric tray 13*b* and is then stored with another sheet of fabric 3. And, its starting end and the terminal end of the fabric sheet being supplied are tied together by the overlocking machine unit M. Then, by providing a plurality of fabric trays 13 at the outlet side, the elongated fabric 3 printed can continuously be piled up successively in these fabric trays.

For a printing operation on the fabric 3, a thickness detection sensor 7 may be provided to constantly detect a thickness of the fabric 3 being supplied into the printing section 12 and to provide a detection signal indicative thereof. In response to the detection signal, a controller (not shown) may be provided which acts to vary the height of a pair of the rollers 8*a* and 8*b* guiding the conveyer belt 8, thereby adequately adjusting the position of the conveyer belt 8 to make a proper spacing between the conveyer belt 8 and a printing head of the textile printing ink jet printer 4.

In this operation, when the fabric tying portion which is overlocked and thus thickened is passed through the textile printing ink jet printer 4, an increase in its thickness more than that of the fabric 3 causes the spacing to be more increased than that in case that the thickness of the fabric 3 normally varies so that the printing head may not be contacted by the fabric tying portion. When the fabric tying portion is detected to leave the printing head, the spacing is restored promptly.

Apropos, the fabric tying portion may be detected not necessarily by means of the thickness detector 7 but may also be detected by mechanically detecting an increase in volume of such a portion.

Referring next to FIGS. 6 to 9, mention is made of a drive mechanism implemented to move the conveyer belt 8 up and down in the textile printing section 12. In each form of implementation, note that while mention is made of one guide roller 8*a* of the upstream and downstream guide rollers 8*a* and 8*b* guiding in pairs the conveyer belt 8, they are constructed identically, operating identically and synchronously.

Figure 6:
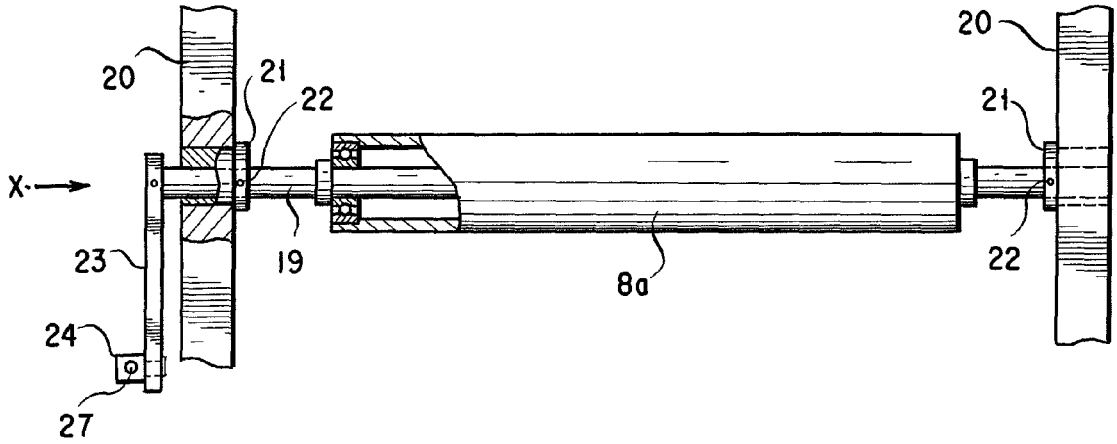
FIG. 6 is a cross sectional view in part broken illustrating a first form of implementation of a guide roller for guiding a conveyer belt.
Figure 7:
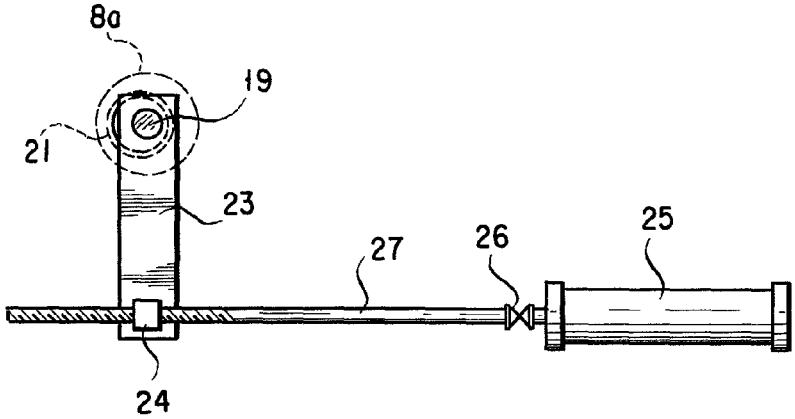
FIG. 7 is a side view as viewed in the direction of arrow X in FIG. 6.

FIGS. 6 and 7 show a first form of implementation in which the guide roller 8*a* is rotatably supported on a roller shaft 19 whose opposed end portions pass through bushes 21 and 21 rotatably supported by a pair of frames 20 and 20 eccentrically about the axes of the bushes, and are secured by pins 22 and 22, respectively. And, the roller shaft 19 has its ends one of which has the base ends of a lever 23 secured thereto. The lever 23 at its tip has a connecting pin 24 mounted thereto rotatably and extending parallel to the roller shaft 19. The connecting pin 24 is formed with a threaded hole extending at a right angle to its axis of rotation, the threaded hole being screwed with a threaded shaft 27 coupled via a universal joint 26 to a servo motor 25.

And now, the servo motor 25 is rotationally driven to rotate the threaded shaft 27 and to rotate the lever 23 via the connecting pin 24 whereby together with the roller shaft 19 the bushes 21 and 21 are rotated over a given angle. Then, the roller shaft 19 which is axially positioned eccentrically about the center of rotation of the bushes 21 and 21 is swung vertically, thereby displacing the guide roller 8*a* vertically.

Figure 8:
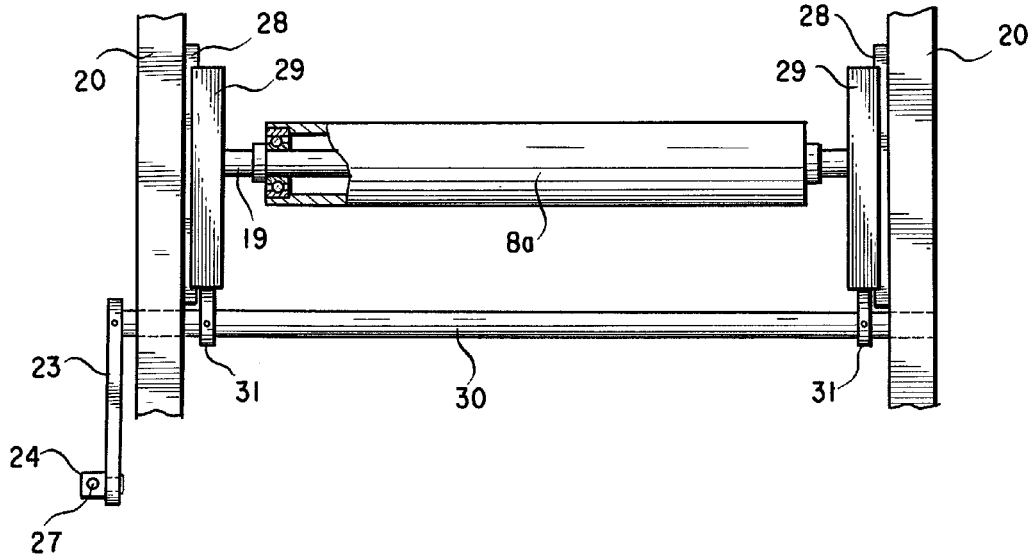
FIG. 8 is a cross sectional view in part broken illustrating a second form of implementation of the guide roller for guiding the conveyer belt.

FIG. 8 shows a second form of implementation in which the components identical to those in the first form of implementation of the drive mechanism are designated by the identical reference characters and their repeated description is omitted. The guide roller 8*a* is rotatably supported on the roller shaft 19 whose opposed ends are fastened to front and back slide frames 29 and 29 slidably engaged vertically with guide plates 28 and 28 which are mounted to a pair of frames 20 and 20, respectively. And, the slide frame 29, 29 are contacted at their lower faces with eccentric cams 31 and 31, respectively, which are fastened to a cam shaft 30 rotatably supported by the frames 20 and 20. The cam shaft 30 is rotated to rotate the eccentric cams 31 and 31 whereby the slide frames 29 and 29 are vertically moved to displace the guide roller 8*a* in position vertically.

The cam shaft 30 is rotated in a construction identical to that of the first form of implementation of the drive mechanism shown in FIG. 7 in that the lever 23 which is linked to one end of the cam shaft 30 is rotationally driven by the servo motor 25 via the connecting pin 24.

Figure 9:
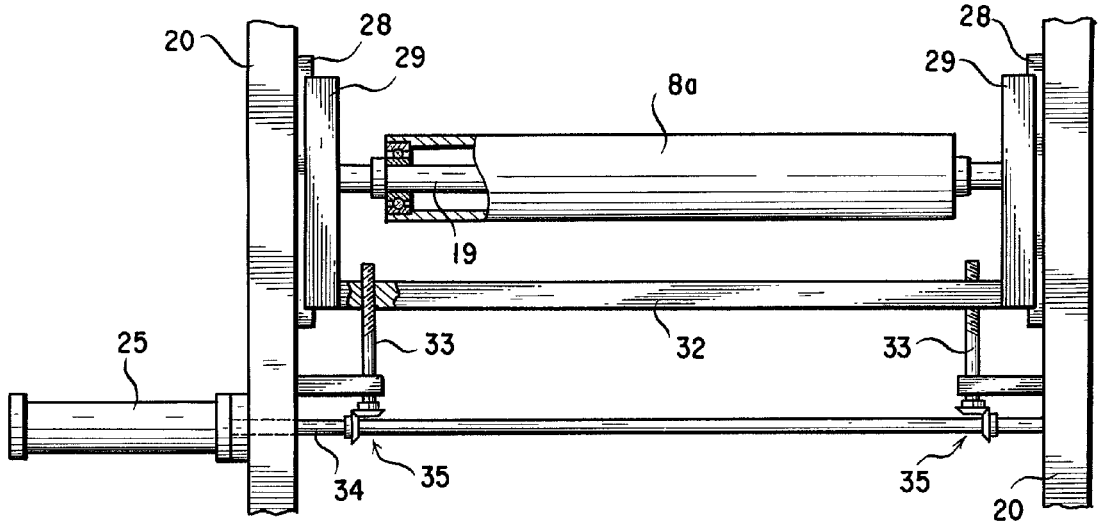
FIG. 9 is a cross sectional view in part broken illustrating a third form of implementation of the guide roller for guiding the conveyer belt.

FIG. 9 shows a third form of implementation in which the components identical to those in the first and second forms of implementation of the drive mechanism are designated by the identical reference characters and their repeated description is omitted. The guide roller 8*a* is rotatably supported on the roller shaft 19 whose opposed ends are fastened to front and back slide frames 29 and 29 slidably engaged vertically with guide plates 28 and 28 which are mounted to a pair of frames 20 and 20, respectively. And, these slide frames 29 and 29 are connected by a stay member 32 whose opposed ends are screwed with threaded shafts 33, respectively. The threaded shafts 33 have their respective lower ends coupled via bevel gear devices 35 and 35, respectively, to a rotary shaft 34 which is rotatably supported through the frames 20 and 20 and driven by the servo motor 25.

And now, the servo motor 25 is rotationally driven to rotate the rotary shaft 34 and in turn to rotate the threaded shafts 33 and 33 via the bevel gear devices 35 and 35 whereby the stay member 32 is vertically moved, thus displacing the guide roller 8*a* in position vertically.

In each of the forms of implementation mentioned above, the servo motor 25 is rotationally driven normally or reversely by the controller in response to the detection signal from the thickness detection sensor 7. Thus, the guide roller 8*a* is vertically displaced up or down in accordance with a thickness of the fabric 3 being printed by the printing head of the textile printing ink jet printer 4 and that of the fabric tying portion being passed to travel thereunder. The spacing between the conveyer belt and the printing head is thus constantly adjusted adequately.

What is claimed is:

1. A textile printing method in which fabric is conveyed by a conveyer belt and passed through a printing section to print on the fabric, the printing section having a textile printing ink jet printer disposed opposite the conveyer belt, characterized in that the method includes continuously supplying said printing section with the fabric comprising a plurality of successive sheets of fabric, each sheet having a given length, such a sheet of fabric to be supplied into said printing section having a terminal end tied with a starting end of a sheet of a fabric to be successively supplied in the state that said terminal and starting ends are in contact with each other.

2. A textile printing method as set forth in claim 1, characterized in that the method includes: detecting by a sensor, upstream of said printing section, a portion of tying one sheet of fabric with another, and in response to the detection, lowering said conveyer belt for fabric conveying while said fabric tying portion is being passed through said printing section so that said tying portion may not interfere with a printing head in said printing section.

3. A textile printing apparatus including a printing section having a textile printing ink jet printer disposed opposite a conveyer belt and in which fabric is conveyed by the conveyer belt and passed through the printing section to print on the fabric with the textile printing ink jet printer, characterized in that the apparatus comprises:

a fabric supply section for supplying the fabric into the printing section, the fabric supply section having a plurality of fabric trays arranged in the direction of supply of the fabric and a fabric joining unit for tying together a terminal end of a sheet of fabric in the fabric tray downstream in the direction of supply of the fabric and a starting end of a sheet of fabric in the fabric tray upstream in the direction of supply of the fabric in the state that said terminal and starting ends are in contact with each other; and a detection sensor for detecting, upstream of said printing section, a portion of tying of one sheet of fabric with another to lower the conveyer belt while the fabric tying portion is being passed through said printing section so that said fabric tying portion may not interfere with a printing head in said printing section.

* * * * *